US007641354B1

(12) United States Patent
Valois et al.

(10) Patent No.: US 7,641,354 B1
(45) Date of Patent: Jan. 5, 2010

(54) FLASHLIGHT CASING CONTAINING RETRACTABLE TOOLS

(76) Inventors: A. Daniel Valois, 3552 W. Lizard Creek Rd., Lehighton, PA (US) 18235; M. Joy Valois, 3552 W. Lizard Creek Rd., Lehighton, PA (US) 18235

( * ) Notice: Subject to any disclaimer, the term of this patent is extended or adjusted under 35 U.S.C. 154(b) by 0 days.

(21) Appl. No.: 12/005,071

(22) Filed: Dec. 26, 2007

(51) Int. Cl.
*B25B 13/16* (2006.01)

(52) U.S. Cl. ..... 362/119; 362/120

(58) Field of Classification Search ..... 362/109–120
See application file for complete search history.

(56) References Cited

U.S. PATENT DOCUMENTS 2,547,816 A * 4/1951 Duncan ..... 362/116
5,313,376 A * 5/1994 McIntosh ..... 362/119
6,464,370 B1 * 10/2002 Ulicny ..... 362/119
6,511,199 B1 * 1/2003 Chung ..... 362/119
7,059,741 B2 * 6/2006 Elsener ..... 362/119
7,178,847 B1 * 2/2007 Mui ..... 294/99.2
7,226,181 B2 6/2007 Galli ..... 362/119

* cited by examiner

*Primary Examiner*—Anabel M Ton
(74) *Attorney, Agent, or Firm*—LaMorte & Associates P.C.

(57) ABSTRACT

An assembly that combines a flashlight with at least one secondary tool element. The flashlight has an elongated casing. At least one tool element is provided. The tool element is coupled to the elongated casing of the flashlight, wherein the tool element is capable of moving reciprocally with respect to the elongated casing between a retracted position and an extended position while remaining coupled to the casing. The tool element lays parallel to the central axis of the flashlight and protrudes beyond the front of the flashlight when in its extended position. A locking mechanism is provided for selectively locking the tool element into its extended position. As such, the tool element can be locked into an extended position in front of the flashlight or retracted back into a stored position along the casing of the flashlight.

14 Claims, 5 Drawing Sheets

FLASHLIGHT CASING CONTAINING RETRACTABLE TOOLS

BACKGROUND OF THE INVENTION

1. Field of the Invention

In general, the present invention relates to the structure of flashlights. More particularly, the present invention relates to flashlights that are combined with a secondary tool, such as a knife blade.

2. Prior Art Description

Flashlights have been commercially available for close to a century. In this long period of time, flashlights have been manufactured in a variety of shapes and styles. Traditionally, a flash light has a tubular casing with a light bulb at one end. The tubular casing holds the batteries needed to power the light bulb. The size of the flashlight is, therefore, dictated by both the size and number of batteries needed to power the light bulb.

In modern times, high output light emitting diodes (LEDs) have been developed. Small, powerful flashlights can be made using such LEDs in place of traditional incandescent light bulbs. The power needed to light an LED is much smaller than the power needed to light an incandescent bulb. Consequently, flashlights can be made much more compact. LED flashlights, however, typically lack the power needed to produce a bright, far reaching beam of light, such as those capable with some larger traditional flashlights.

It will be understood that a flashlight is a very useful tool. Accordingly, manufacturers have combined flashlights with other useful tools, such as knives, in a single assembly. When a flashlight and other tools are combined into a single assembly, typically smaller LED flashlights are used in order to conserve space and reduce weight. For example, many modern Swiss army knives now contain a small LED flashlight that folds into the casing of the pocket knife.

Flashlights small enough to be folded into the casing of a pocket knife only provide a limited amount of light. If greater illumination power is needed, assemblies with large flashlights must be used. In U.S. Pat. No. 7,226,181 to Galli, entitled Housing With A Compartment For A Removable Pocket Knife, a flashlight/tool assembly is shown where a pocket knife is stored in the end of a traditional flashlight casing. Although, the flashlight is powerful, the knife blade is made small enough to fit within the confines of the flashlight casing. Furthermore, the light faces in the opposite direction than the pocket knife. The flashlight, therefore, cannot be used to illuminate an object being cut by the flashlight while the flashlight and the knife are connected.

In certain situations, large flashlights are selected because the casing of the flashlight can be used as a weighted club. Such flashlights are often used by law enforcement officers, night guards and armed personnel. Since part of the utility of a larger flashlight is its potential use as a weapon, any knife or tool added to the flashlight should enhance this purpose by providing a blade large enough to be used as a weapon.

A need therefore exists for a combined flashlight/knife assembly that contains a powerful flashlight, with a large knife blade, wherein the blade is retractable into the flashlight, yet can be extended rapidly in an emergency. This need is met by the present invention as described and claimed.

SUMMARY OF THE INVENTION

The present invention is an assembly that combines a flashlight with at least one secondary tool element, such as a knife blade. The assembly includes a flashlight. The flashlight has an elongated casing with a first end from which light shines. The elongated casing has a central axis and is hollow to hold a line of batteries.

At least one tool element is provided. The tool element is coupled to the elongated casing of the flashlight, wherein the tool element is capable of moving reciprocally with respect to the elongated casing between a retracted position and an extended position while remaining coupled to the casing. The tool element lay parallel to the central axis of the flashlight and protrudes beyond the front of the flashlight when in its extended position.

A locking mechanism is provided for selectively locking the tool element into said extended position. As such, the tool element can be locked into an extended position in front of the flashlight or retracted back into a stored position along the casing of the flashlight.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
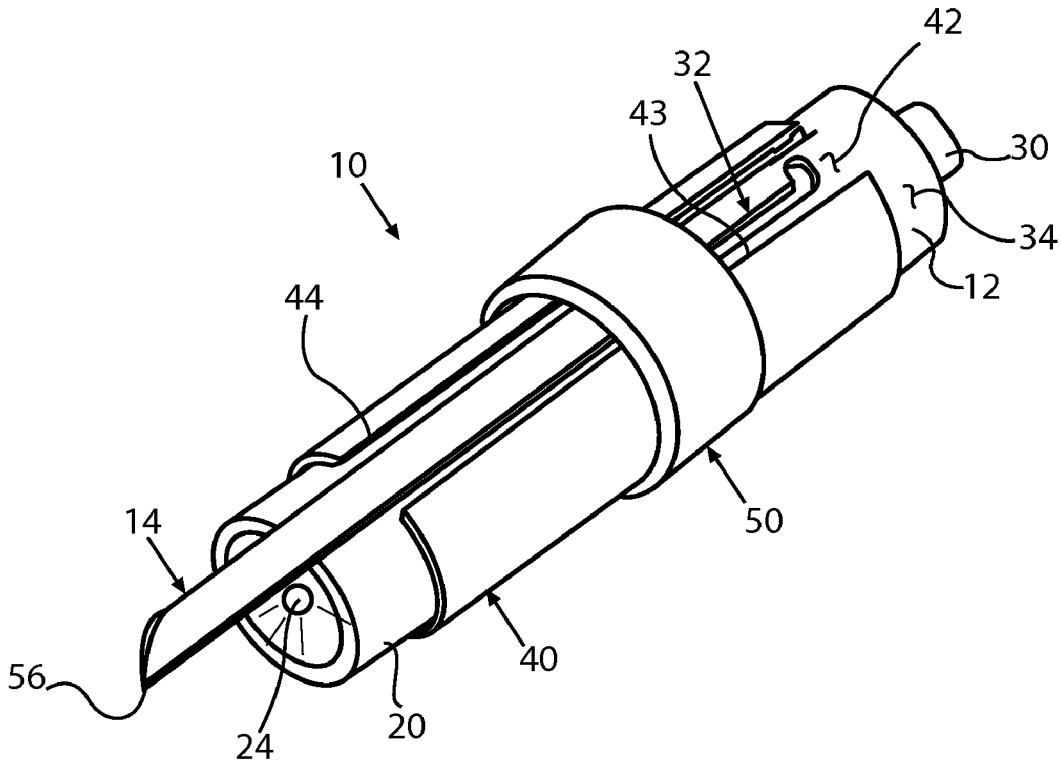
FIG. 1 is a perspective view of an exemplary embodiment of a multi-tool assembly that contains both a flashlight and a knife blade.
Figure 2:
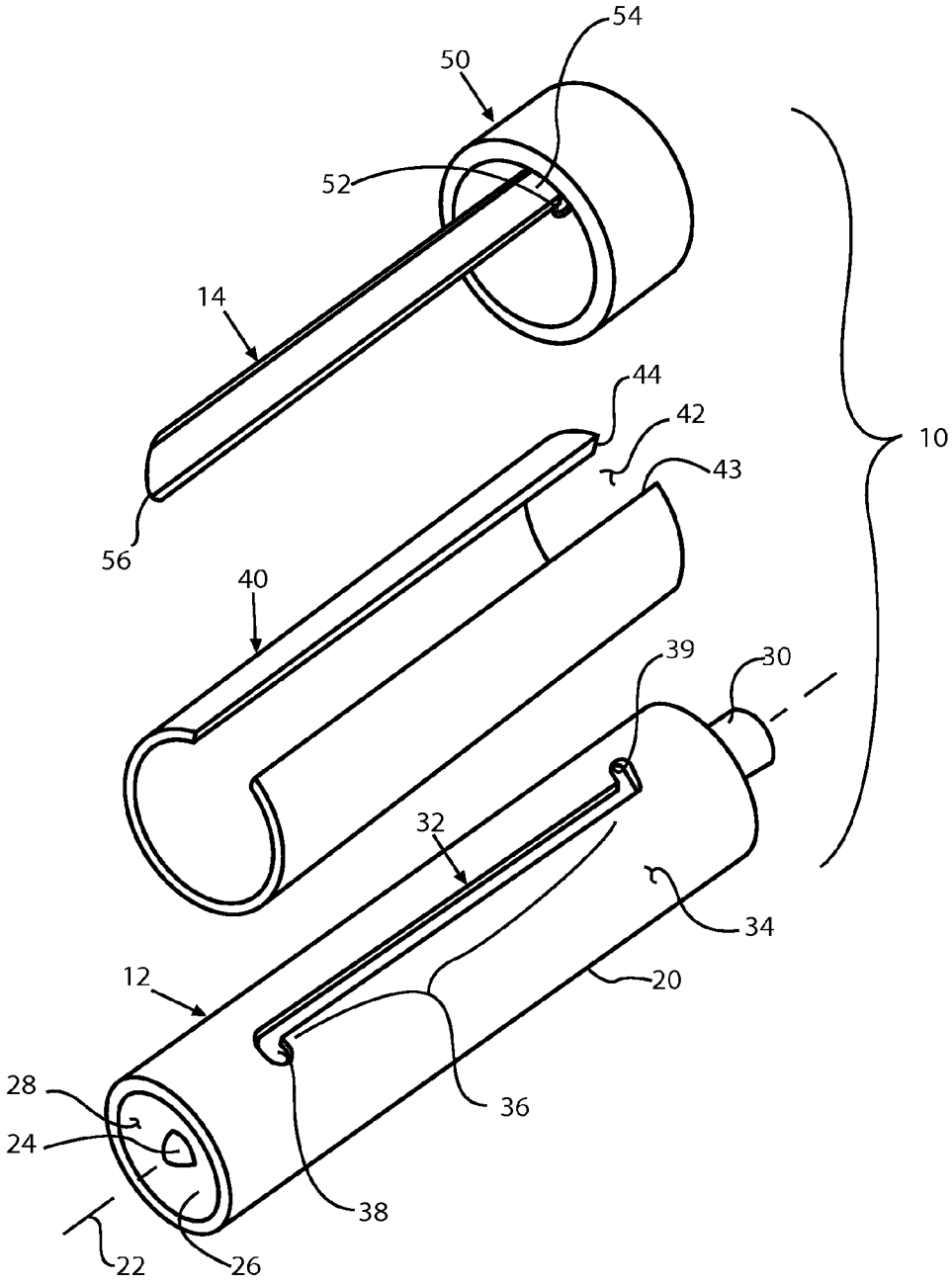
FIG. 2 is an exploded view of the embodiment of FIG. 1.

Referring in combination to both FIG. 1 and FIG. 2, there is shown a multi-tool assembly 10. The multi-tool assembly 10 includes both a flashlight 12 and a knife blade 14, as will be further explained. The multi-tool assembly 10 contains a cylindrical housing 20. The cylindrical housing 20 runs along an imaginary longitudinal axis 22, which is illustrated for reference purposes.

A light bulb 24 is set at one end of the cylindrical housing 20. The light bulb 24 is disposed in the center of a parabolic reflector 26 and is protected by a transparent window 28, as is traditional in flashlight design. The light bulb 24 is powered by batteries that are stored end-to-end inside the cylindrical housing 20.

In the shown embodiment, an on/off switch 30 is provided at the end of the cylindrical housing 20 opposite the light bulb 24. The on/off switch 30 controls the operation of the flashlight function. It will be understood that the shown positioning of the on/off switch 30 is exemplary and that the on/off switch 30 can be located at another point.

A groove 32 is formed in an exterior surface 34 of the cylindrical housing 20. The groove 32 has a long central segment 36 that runs parallel to the longitudinal axis 22 of the cylindrical housing 20. At both ends of the central segment 36 of the groove 32, the groove 32 turns ninety degrees into opposing lateral segments 38, 39.

A protective sleeve 40 with a C-shaped cross-section is affixed to the exterior of the cylindrical housing 20. The protective sleeve 40, being C-shaped, presents a large channel 42 where the underlying cylindrical housing 20 remains uncovered. The protective sleeve 40 is attached to the cylindrical housing 20 so that the groove 32 in the cylindrical housing 20 lies in the center of the channel 42 defined by the protective sleeve 40.

The protective sleeve 40 has two edges 43, 44 that define the sides of the channel 42. One of the edges 44 is beveled. The beveling creates a small overhang along the edge 44. The purpose of the beveled edge 44 is later explained.

An annular collar 50 is provided that is sized to slide over both the cylindrical housing 20 and its surrounding protective sleeve 40. A guide cam 52 extends inwardly from the annular collar 50. The guide cam 52 engages the groove 32 formed in the exterior surface 34 of the cylindrical housing 20. Accordingly, the annular collar 50 can only travel along the length of the cylindrical housing 20 when the guide cam 52 is within the long central segment 36 of the groove 32. Likewise, the annular collar 50 can only rotate about the cylindrical housing 20 and the protective sleeve 40, when the guide cam 52 is within the lateral segments 38, 39 of the groove 32. Even then, the rotational movement of the annular collar 50 is limited by the short length of the lateral segments 38, 39 of the groove 32.

A knife blade 14 is provided. The knife blade 14 has a base end 54, a tip end 56 and a sharpened edge 58 that runs from the tip end 56 down toward the base end 54. The knife blade 14 has a length between its base end 54 and its tip end 56 that is at least as long as half of the length of the cylindrical housing 20. Preferably, the knife blade 14 has a length at least as long as three-quarters the length of the cylindrical housing 20. The knife blade 14 has a constant curvature along its length. The curvature of the knife blade 14 matches the curvature of the exterior of the cylindrical housing 20. Consequently, the knife blade 14 can lay flush against the curved exterior surface 34 of the cylindrical housing 20.

The base end 54 of the knife blade 14 is affixed to the annular collar 50. It will therefore be understood that when the annular collar 50 is moved down away from the light bulb end of the flashlight 12, the knife blade 14 lays flush against the cylindrical housing 20. Furthermore, the knife blade 14 lays within the channel 42 defined by the protective sleeve 40. The tip end 56 of the knife blade 14 therefore does not protrude forward of the flashlight 12 when the annular collar 50 is in its lowest retracted position. Conversely, when the annular collar 50 is slide forward into an extended position, the tip end 56 of the knife blade 14 protrudes forward of the cylindrical housing 20. The knife blade 14 is therefore exposed and can be used.

Figure 3:
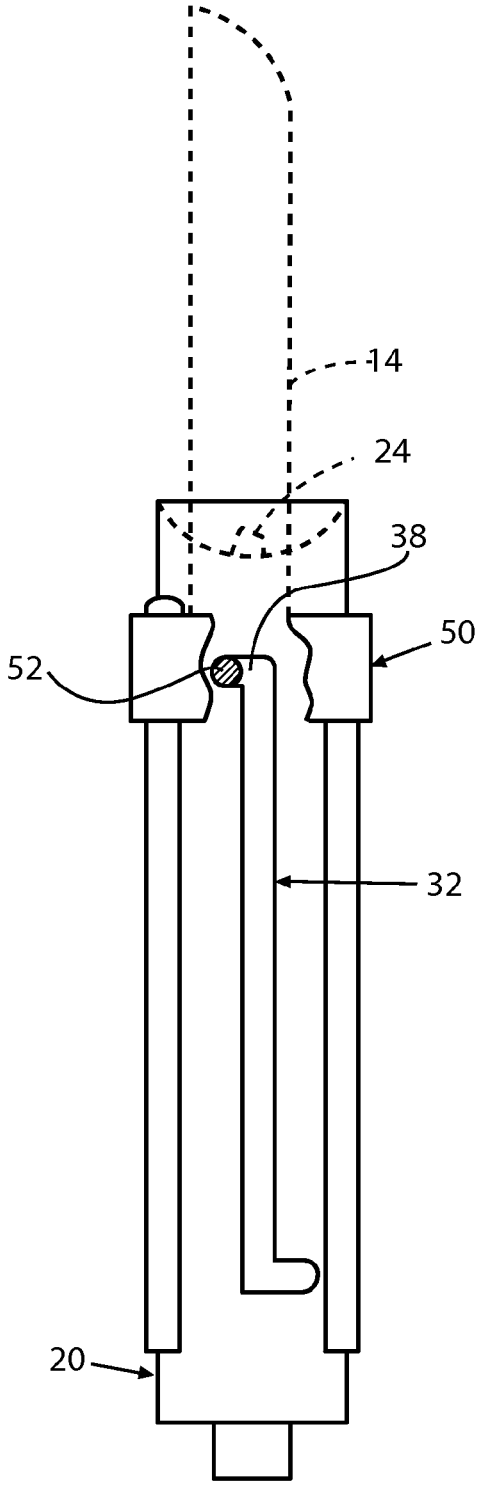
FIG. 3 is a partially fragmented view of the embodiment of FIG. 1, with the knife blade shown in an extended position.

Referring to FIG. 3, the multi-tool assembly 10 is shown with the knife blade 14 in its fully extended position. The knife blade 14 can be locked in its fully extended position by rotating the annular collar 50 so that the guide cam 52 inside the annular collar 50 rests inside the forward lateral segment 38 of the groove 32. When in the forward lateral segment 38, the annular collar 50 cannot slide along the length of the cylindrical housing 20 and the knife blade 14 is locked into its extended configuration.

When fully extended, it will be understood that the light from the light bulb 24 can shine light along the inside of the knife blade 14 in the same direction that the knife blade 14 is pointing. In this manner, the light bulb 24 can be used to illuminate the knife blade 14 and any object brought into contact with the knife blade 14.

Figure 4:
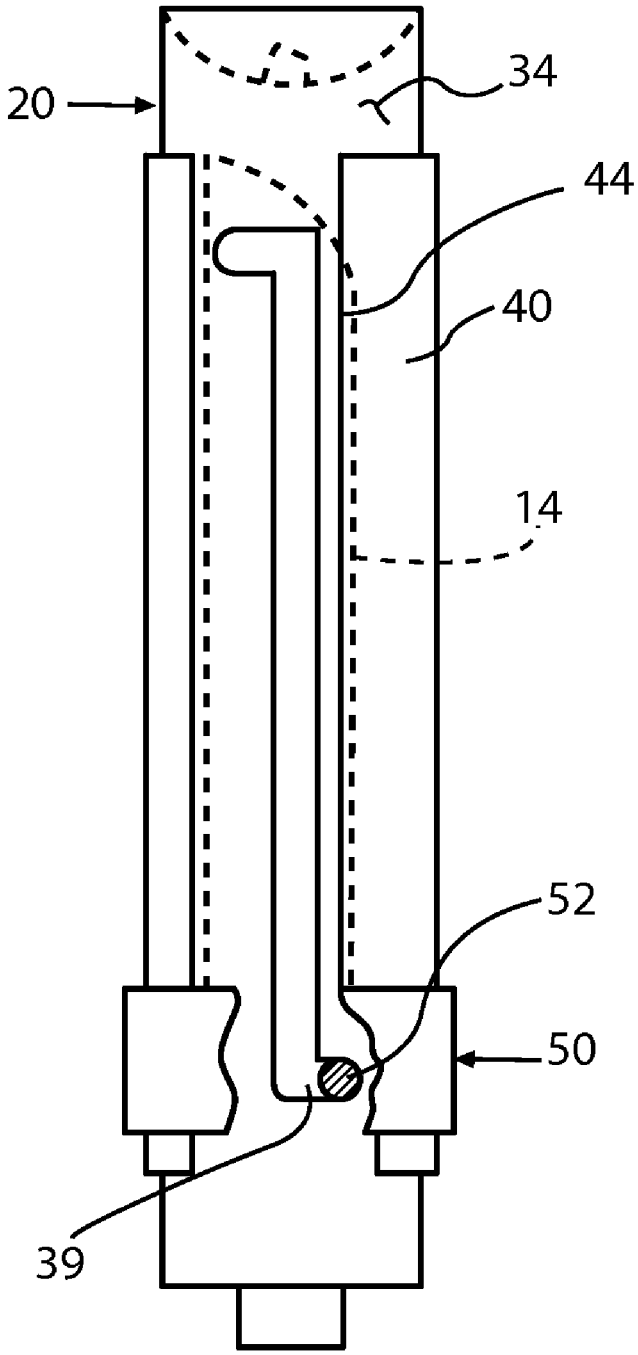
FIG. 4 is a partially fragmented view of the embodiment of FIG. 1, with the knife blade shown in a retracted position.

Referring to FIG. 4, it can be seen that when the annular collar 50 is pulled back into its fully retracted position, the knife blade 14 retreats and lays against the exterior surface 34 of the cylindrical housing 20. The knife blade 14 can be locked into this retracted position by rotating the annular collar 50 so that the guide cam 52 slides into the lower lateral segment 39 of the groove 32. Furthermore, by rotating the guide cam 52 into the lower lateral segment 39, the knife blade 14 is rotated under the edge 44 of the protective sleeve 40. The exterior of the multi-tool assembly 10 can, therefore, be grasped without concern of being cut by the knife blade 14.

Figure 5:
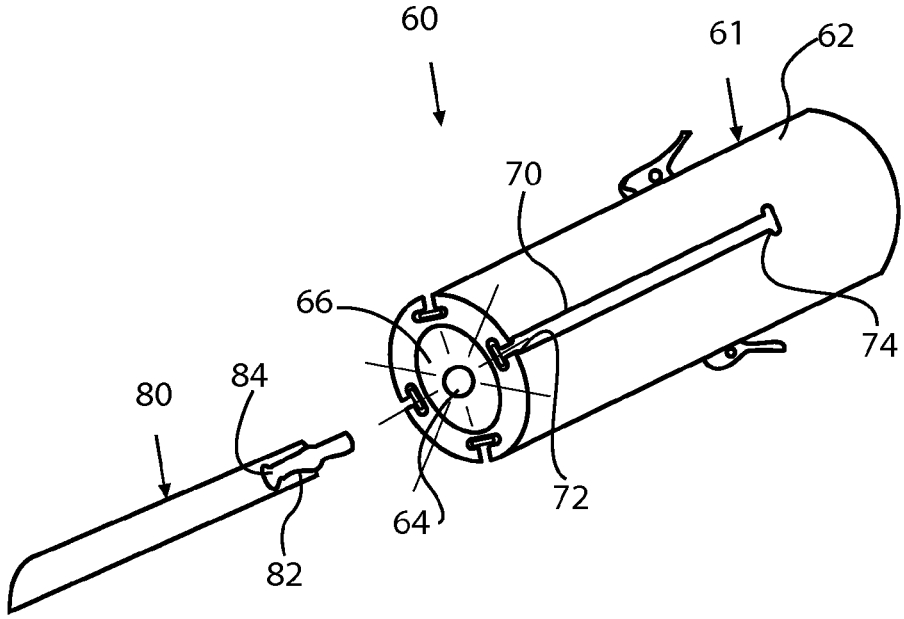
FIG. 5 is a perspective view of an alternate embodiment of a multi-tool assembly.

Referring to FIG. 5, an alternate embodiment of a multi-tool assembly 60 is shown. In this embodiment, there is again a flashlight 61 with a cylindrical housing 62. The cylindrical housing 62 has a light bulb 64 and parabolic reflector 66 at one end. The cylindrical housing 62 holds the batteries needed to power the light bulb 64.

A plurality of T-shaped slots 70 are formed in the cylindrical housing 20. Furthermore, two locking configurations 72, 74 are provided at opposite ends of each of the T-shaped slots 70.

A plurality of tool elements 80 are provided. The tool elements 80 can have a variety of configurations, such as a knife blade, saw blade, can opener and the like. Each tool element 80 is formed from an elongated piece of steel that is sized to fit within the T-shaped slot 70. It will therefore be understood that each of the tool elements 80 can be reciprocally moved within the confines of a T-shaped slot 70. Each tool element 80 has a length that is slightly shorter than the length of a T-shaped slot 70. In this manner, it will be understood that each tool element 80 can be fully retracted into a T-shaped slot 70, if desired.

A spring clip 82 is affixed to the base of each of the tool elements 80. The spring clip 82 extends out of the T-shaped slot 70 so that it can be manually manipulated. The spring clip engages the locking configurations 72, 74 at opposite sides of each slot. It will therefore be understood that the spring clip 82 enables each of the tool elements 80 to be locked either in a fully retracted position or in a fully extended position.

As with the earlier embodiment, a tool element 80, such as a knife blade, can be extended forward from the casing of a flashlight 61 so that the flashlight 61 becomes the handle of the tool element 80. Furthermore, by extending the tool element 80 forward of the flashlight 61, the light from the flashlight 61 can be used to illuminate both the extending tool element 80 and the object being contacted with the tool element 80.

It will be understood that the embodiments of the present invention that are illustrated and described are merely exemplary and that a person skilled in the art can make many variations to the selected embodiments. For example, the length of the various cylindrical housings and the tool elements can be changed. Furthermore, the configuration of the tool elements are a matter of design choice. All such variations, modifications and alternate embodiments are intended to be included within the scope of the present invention as defined by the claims.

What is claimed is:

1. An assembly comprising;

a flashlight having an elongated casing with a first end from which light shines, wherein said elongated casing has a central axis;

an annular collar that is positioned around said elongated casing that can be selectively moved reciprocally along said elongated casing;

a tool element coupled to said annular collar, wherein said tool element moves reciprocally with said annular collar along said elongated casing between a retracted position and an extended position while remaining coupled to said casing through said annular collar, wherein said tool element lays parallel to said central axis and protrudes beyond said elongated casing when said tool element is in said extended position; and a locking mechanism for selectively locking said tool element into said extended position.

2. The assembly according to claim 1, wherein said tool element is a knife blade.

3. The assembly according to claim 1, wherein said tool element extends beyond said first end of said elongated casing when in said extended position.

4. The assembly according to claim 1, wherein a groove is disposed on said elongated casing, and wherein said tool element engages said groove when reciprocally moving between said retracted position and said extended position.

5. The assembly according to claim 1, wherein a guide cam extends inwardly from said annular collar and rides in a groove that is formed in said elongated casing.

6. An assembly, comprising;

a flashlight having a cylindrical casing extending between a first end and a second end, wherein said cylindrical casing has a curved exterior surface;

a curved knife blade capable of laying flush against said curved exterior surface of said cylindrical casing; and an annular collar that moves reciprocally over at least a portion of said cylindrical casing, wherein said curved knife blade is anchored to said annular collar and moves with said annular collar between a retracted position and an extended position.

7. The assembly according to claim 6, wherein said curved knife blade extends beyond said first end of said cylindrical casing when in said extended position.

8. The assembly according to claim 7, wherein said curved knife blade lays on said curved exterior surface of said cylindrical casing between said first end and said second end when in said retracted position.

9. The assembly according to claim 5, further including a groove running in said curved exterior surface of said cylindrical casing.

10. The assembly according to claim 9, wherein said annular collar has an inwardly extending guide cam that rides in said groove, wherein said groove limits movements of said annular collar relative to said cylindrical casing.

11. The assembly according to claim 5, further including a locking mechanism for locking said knife blade in said extended position.

12. The assembly according to claim 5, wherein said annular collar is capable of rotating about said cylindrical casing between a first position and a second position when said knife blade is in said retracted position.

13. The assembly according to claim 12, further including a recessed ledge on said curved exterior surface of said cylindrical casing.

14. The assembly according to claim 13, wherein said knife blade has a sharpened edge and said sharpened edge rotates under said recessed ledge when said annular collar is rotated from said first position to said second position.

* * * * *